US005287660A

United States Patent [19]

Bellati et al.

[11] Patent Number: 5,287,660

[45] Date of Patent: Feb. 22, 1994

[54] PLANING MACHINE FOR WOOD FLOORS

[76] Inventors: Olga Bellati, Via Provinciale, 114, 46030 Serravalle PO (Prov. of Mantova), Italy; Francesco Debiasi, Via Sanguinetto, 10b, 46026 Quistello (Prov. of Mantova), Italy

[21] Appl. No.: 73,905

[22] Filed: Jun. 9, 1993

Related U.S. Application Data

[63] Continuation of Ser. No. 922,405, Jul. 31, 1992, abandoned.

[51] Int. Cl.[5] ..... B24B 23/00; B27C 1/02

[52] U.S. Cl. ..... 51/176; 30/475; 144/117 C

[58] Field of Search ..... 144/117 C, 252 R; 409/178, 175, 181, 182; 30/475; 51/176

[56] References Cited

U.S. PATENT DOCUMENTS

| | | | |
|---|---|---|---|
| 1,614,855 | 1/1927 | Stubblefield | 144/117 C |
| 1,974,136 | 9/1934 | Emmons | 51/176 |
| 2,148,061 | 2/1939 | Emmons | 51/176 |
| 2,224,437 | 12/1940 | La Salle | 51/176 |
| 2,265,354 | 12/1941 | Dahl | 144/117 C |
| 2,323,082 | 6/1943 | Ballard | 51/176 |
| 2,342,267 | 2/1944 | Goff | 144/117 C |
| 2,395,268 | 2/1946 | Goodridge | 144/117 C |
| 2,588,707 | 3/1952 | Dwyer | 51/176 |
| 2,718,246 | 9/1955 | Norberg | 144/117 C |
| 3,422,579 | 1/1969 | Rogge et al. | 51/176 |
| 3,702,149 | 11/1972 | Thompson | 144/117 C |

FOREIGN PATENT DOCUMENTS 0261658 9/1987 European Pat. Off. .

*Primary Examiner*—W. Donald Bray

*Attorney, Agent, or Firm*—Guido Modiano; Albert Josif; Daniel O'Byrne

[57] ABSTRACT

The planing machine for wood floors includes a truck with retractable front wheels and with a rear wheel which is provided with means for varying the attitude of the machine when the direction of motion changes; a treatment head which is provided with two abrasive paper supporting rollers which rotate in different directions, is articulately supported by the truck and is provided with a portion which is in contact with elastic positioning and contrast means; an aspirator which conveys the wood dust into a collecting bag; and at least one electric motor which drives the rollers which support the abrasive paper and the aspirator.

6 Claims, 2 Drawing Sheets

PLANING MACHINE FOR WOOD FLOORS

This is a continuation application of application Ser. No. 07/922,405 filed on Jul. 31, 1992, now abandoned.

BACKGROUND OF THE INVENTION

The present invention relates to a planing machine for wood floors.

It is known that wood floors, after laying, must be treated with planing machines which provide perfect leveling, eliminating the unevennesses which are always present in the regions of connection between one element and the other of the floor.

The planing machines currently commercially available, which comprise a motorized roller which presses against the floor to be treated abrasive paper which can embrace the roller completely or can have the shape of a belt guided around an overlying pulley, have a severely disadvantageous characteristic which consists in a particularly onerous manual actuation.

These machines are in fact moved backward and forward by small extents by an operator who must brake the machine when it moves in the direction induced by the rotation of the roller and must, with an even greater effort, overcome the action of the roller in order to produce motion in the opposite direction.

SUMMARY OF THE INVENTION

The aim of the present invention is to provide a planing machine for wood floors which has maximum ease in manual handling for the operator, so as to spare him from any actuation effort, and can optimize its functional characteristics according to the conditions of the floors to be treated.

This aim is achieved by a planing machine for wood floors, according to the invention, characterized in that it comprises:

- a truck which is frontally provided with a pair of retractable floor resting wheels and, in a rearward position, with a floor resting wheel which is provided with means suitable for automatically varying the attitude of the machine upon the variation of the direction of motion thereof, a handle suitable for being gripped by an operator extending from a rear region of said truck;
- a treatment head which comprises two rollers for supporting abrasive paper which are motorized with different rotation directions, said head being supported by the truck so as to be articulated with an articulation axis which is transverse to the direction of the motion of the machine and being provided with a portion which is in contact with elastic contrast and positioning means which are rigidly associated with the truck;
- an aspirator which is suitable for conveying into a collection bag the wood dust produced during treatment;
- at least one electric motor for moving the abrasive paper supporting rollers and the aspirator.

BRIEF DESCRIPTION OF THE DRAWINGS

Further characteristics and advantages will become apparent from the following description of a preferred but not exclusive embodiment of the invention, illustrated only by way of non-limitative example in the accompanying drawings, wherein.

DESCRIPTION OF THE PREFERRED EMBODIMENTS

Figure 3:
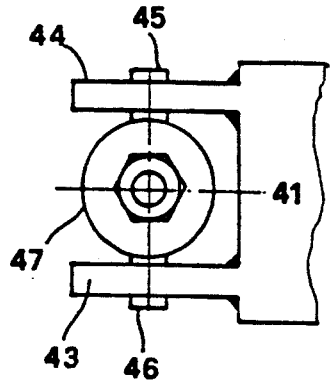
FIG. 3 is a partial bottom view of the extreme left region of FIG. 2.

With reference to the above figures, the planing machine comprises a truck 1, which is frontally provided with the wheels 2 and 3 for resting on the floor, which can be retracted into the truck from a more protruding position, assumed during the idle movements of the machine, i.e. when it is not operating, according to a per se known mechanism which comprises an axis 4 which supports said wheels by means of arms such as 3*a* for the wheel 3 and is rotated by an appropriate angle in the presence of the spring 5 by means of the manual actuation of a lever device, generally indicated by the reference numeral 6, which is arranged directly below the handle 7 of the machine.

In a rearward position, the truck 1 is provided with a wheel 8, which is intended to rest constantly on the floor, and said wheel is provided with means suitable for automatically varying the attitude or plane of lay of the machine when the direction of motion thereof changes; said means, visible in particular in FIG. 2 and generally indicated by the reference numeral 9, will be described hereinafter.

Figure 1:
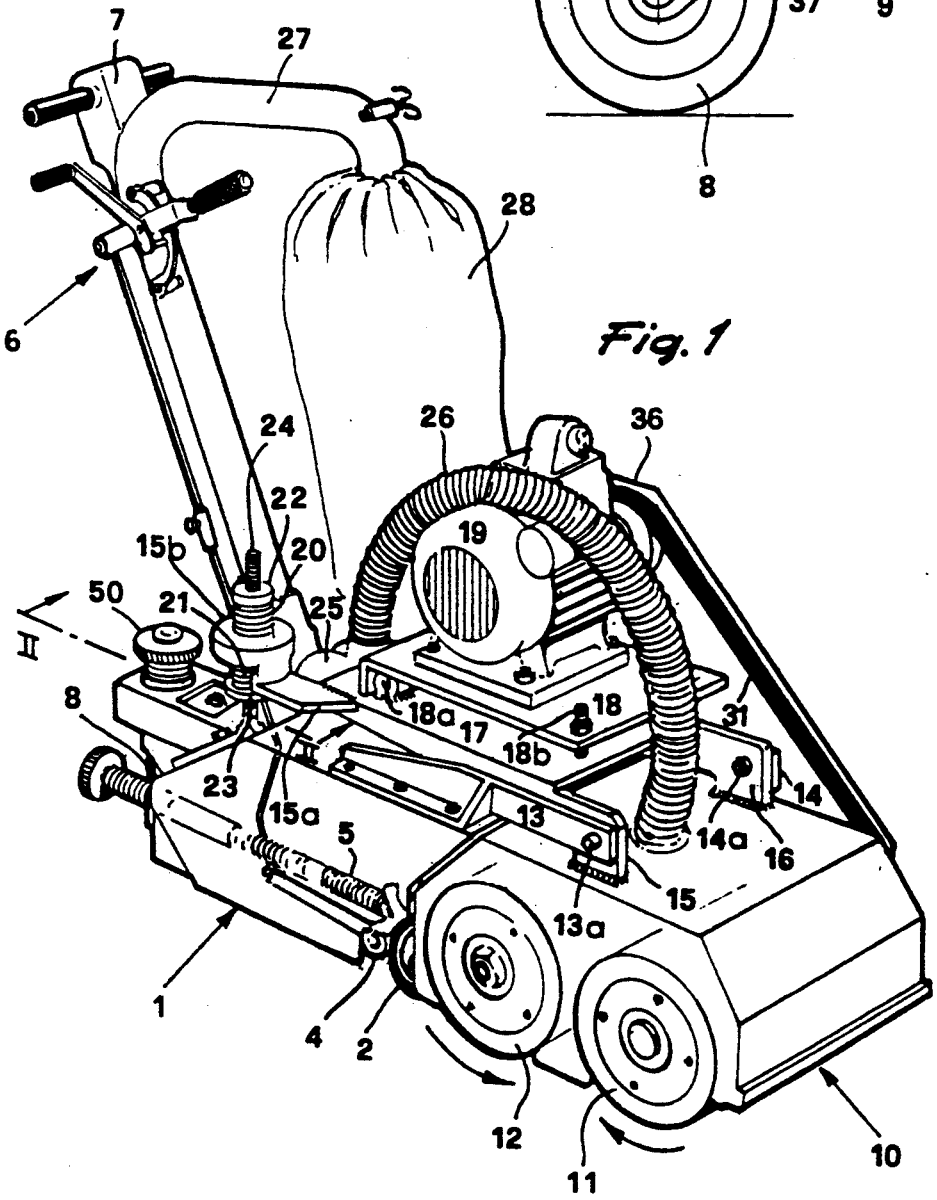
FIG. 1 is a perspective view of the machine.

The reference numeral 10 furthermore indicates a treatment head which, according to an important characteristic of the invention, comprises two rollers 11 and 12 for supporting abrasive paper, which are motorized with different rotation directions, as indicated by the arrows of FIG. 1; said head is supported by brackets 13 and 14 which extend from the truck 1 by means of two pivots 13*a* and 14*a* which are inserted in flat profiled elements 15 and 16 which are rigidly associated with the cover of said head 10: this produces an articulated support of the head 10 with respect to the truck 1, with an articulation axis which is transverse with respect to the direction of the motion of the machine.

The flat profiled elements 15 and 16 extend so as to monolithically support a plane 17, on which a support 18 is pivoted at 18*a*; said support 18 has a threaded contrast stem 18*b* and supports an electric motor 19 which supplies motion, according to methods described hereinafter, to all the moving elements of the machine.

A wing or contact portion 15*a* extends monolithically from the profiled element 15 and extends into a disk 15*b*, which is in contact with elastic positioning and contrast means, since it is inserted between the facing ends of springs 20 and 21 which are in contact, at their other end, with disks 22 and 23 are coupled to a threaded rod or stem 24 which is pivoted in a downward position on the structure of the truck 1; by acting on the disks 22 and 23 it is possible to both determine the position of the treatment head 10 with respect to the truck 1 and to adjust the contrast force which said treatment head encounters when, during operation, it tends to perform rotations about the articulation constituted by the pivots 13*a* and 14*a*.

An aspirator 25 is accommodated within the truck 1 and has its intake connected, by means of the flexible hose 26, to the treatment head 10, so as to convey the wood dust which forms during treatment into a tube 27 which supports the handle 7 and leads, at its end, into a collection bag 28.

As previously mentioned, the electric motor 19 powers both the aspirator 25, by means of a first belt 29 which is put under tension by a belt tensioner 30, and the abrasive paper supporting rollers 11 and 12, which rotate in opposite directions, by means of a second belt 31 which acts on pulleys 32 and 33 which are respectively keyed on the shafts of the rollers 11 and 12, in the presence of transmission pulleys 34 and 35; a housing 36, which is illustrated only in FIG. 1, constitutes the protection of said belts.

Figure 2:
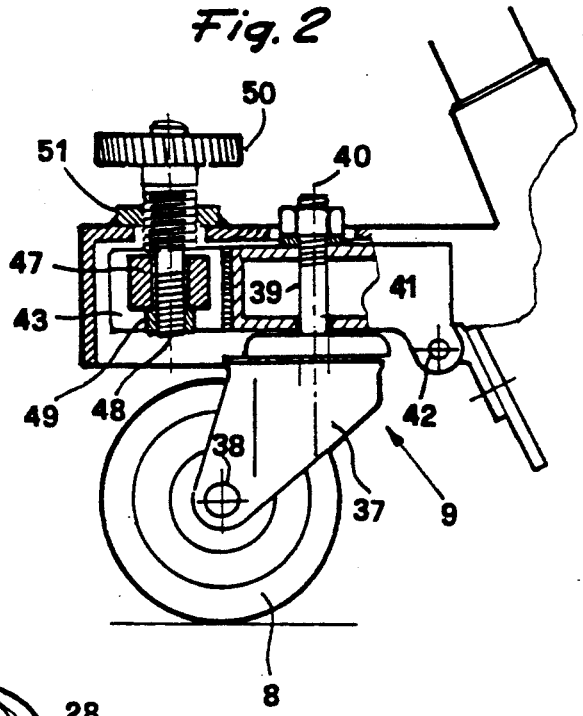
FIG. 2 is a partial sectional view, taken along the plane II—II of FIG. 1.

With particular reference to FIGS. 2 and 3, the means 9, with which the wheel 8 is provided and which are suitable for automatically varying the attitude of the machine when its direction of motion changes, are now described.

Said means thus comprise a support 37, which is provided with the wheel 8 which is pivoted at pivot axis 38 and which rotates freely about a pivot 39 at a rotation axis 40 which does not pass through the pivot axis 38 and is connected to an arm 41; said arm is pivoted, at one end, at a mounting axis 42, on the structure of truck 1, and is provided, at the other end, with a fork or fork-like member defined by a pair of secondary arms 43 and 44 which are connected to wings 45 and 46 of a block 47 which has a through hole for a stem 48 of a traction screw with a self-locking nut 49 and actuation knob 50, which is mated with a female thread which is included in a disk 51 which is rigidly associated with the structure of the truck 1.

Figure 5:
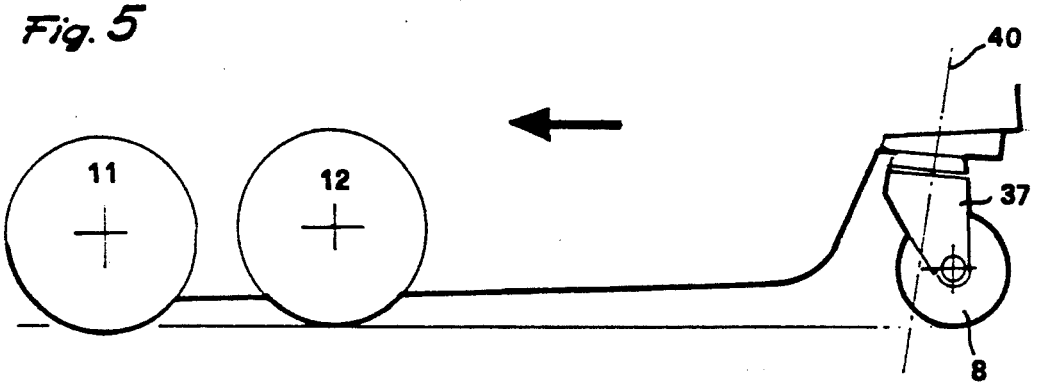
FIGS. 5 and 6 are schematic views of the different attitudes assumed by the machine in the two opposite advancement directions.
Figure 6:
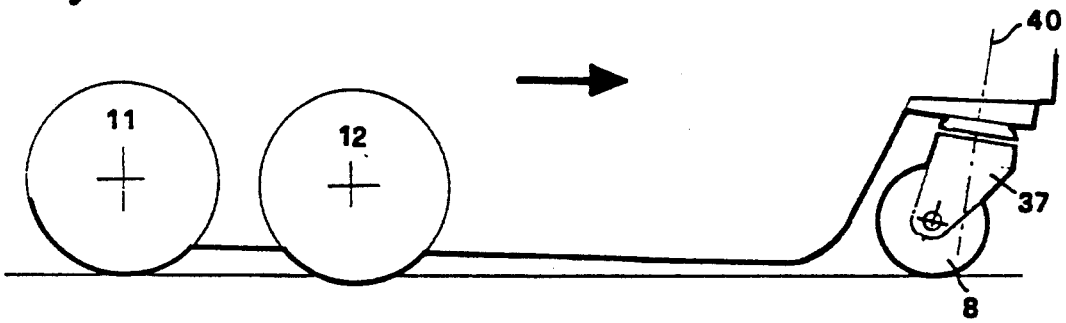
Figure 4:
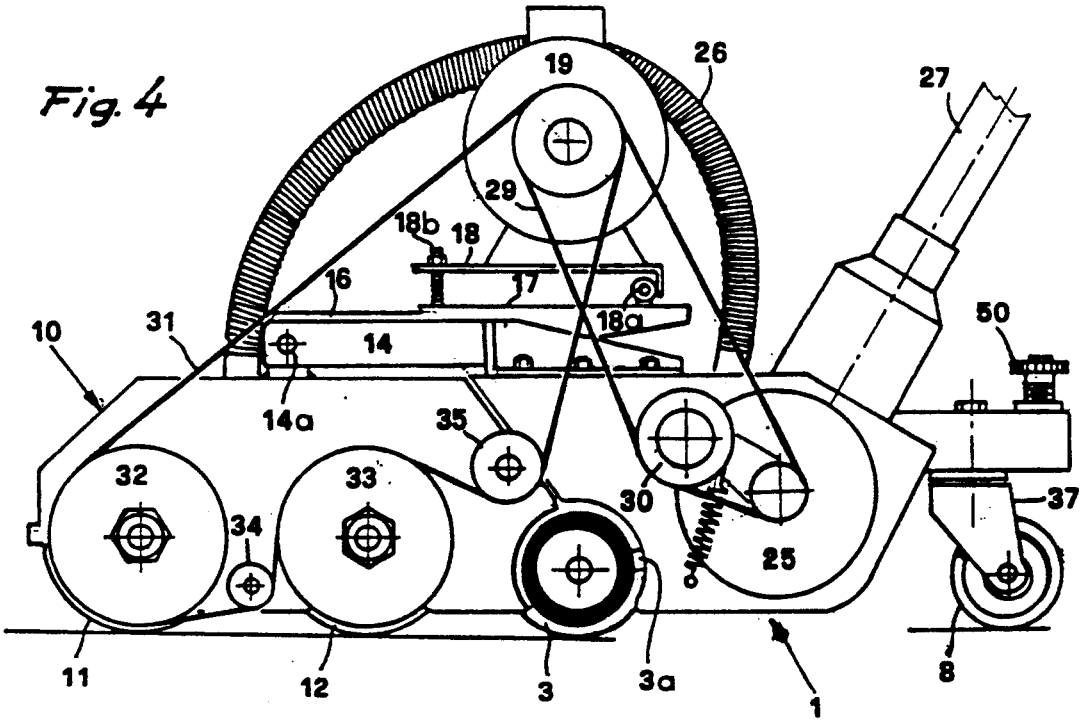
FIG. 4 is an elevation view of the machine at the side opposite to the one shown in FIG. 1 and without the housing for covering the kinematic systems defined therein.

The automatic operation of the means 9 is based on the fact that, due to stability reasons, the support 37 rotates about the pivot 39 so as to always move the point of contact of the wheel 8 with the floor into a rearward position with respect to the axis of said pivot, as can be seen in FIGS. 5 and 6, wherein an arrow indicates the direction of motion of the machine.

When the pivot 39 is in the condition of FIG. 2, with the axis 40 perpendicular to the floor, the position of the support 37 on one side or on the other with respect to said pivot is obviously indifferent in terms of the attitude of the machine.

If instead one wishes the attitude of the machine to vary when its direction of motion varies, for example so that the abrasive paper supporting roller which is arranged further forward in the direction of motion is lower than the subsequent one, it is sufficient to act on the knob 50 and produce a rotation of the arm 41, with the consequent inclination of the axis 40 of the pivot 39 by the extent most suitable for optimizing the functional characteristics in relation to the conditions of the floor to be treated.

When the axis 40 of the pivot 39 is inclined, the situation visible in FIGS. 5 and 6 occurs, i.e. when the machine moves to the left, as in FIG. 5, the roller which exerts its action more deeply in the floor is the roller 11, which is the one arranged further forward in this direction of motion, whereas when the machine moves to the right the attitude thereof is changed, and the lowest roller is the roller 12, which in this direction of motion is indeed the roller arranged further forward.

From all the above description it can thus be deduced that the machine according to the invention has a particularly easy actuation, since the balance of the thrusts exerted on the machine by the two rollers of the treatment head, which rotate in opposite directions, allows the operator to move the machine in both directions with minimal effort.

The machine operates in optimum conditions also from the point of view of the quality of the obtained work, particularly by virtue of the presence of the articulation between the truck and the treatment head, and also by virtue of the possibility of varying the attitude of said machine, providing a floor levelling which is fully free from scratches and undulations.

The described invention is susceptible to numerous modifications and variations, all of which are within the scope of the inventive concept; all the details may furthermore be replaced with other technically equivalent elements.

In the practical embodiment of the invention, the materials employed, as well as the shapes and dimensions, may be any according to the requirements.

We claim:

1. Planing machine for wooden floors comprising:
- a truck having a front portion and a rear portion, said truck defining in use a direction of motion;
- a pair of retractable floor resting wheels connected to said front portion of said truck;
- a single floor resting wheel connected to said rear portion of said truck;
- a plane of lay defined by said planing machine;
- means connected to said single floor resting wheel for automatically varying said plane of lay of said planing machine upon changing said directions of motion;
- a grip handle extending upwardly from said rear portion of said truck;
- a treatment head articulated to said truck about an articulation axis, said articulation axis being transverse with respect to said direction of motion;
- two rollers connected to said truck for supporting abrasive paper, said rollers being driven to define different directions of rotation;
- a contact portion defined by said treatment head;
- elastic biasing and positioning means fixed to said truck and contacting said contact portion of said treatment head;
- a collection bag connected to said planing machine;
- an aspirator for conveying wood dust produced during operation of said planing machine into said collection bag, and
- at least one electric motor for powering said two rollers and said aspirator.

2. Planing machine according to claim 1, wherein said means connected to said single floor resting wheel for automatically varying said plane of lay of said planing machine upon changing said direction of motion comprise;
- inclination adjustment means connected to said truck, and;
- a support pivotally connected to said inclination adjustment means at a rotation axis, said support rotatably supporting said single floor resting wheel at a pivot axis;
- wherein said rotation axis does not pass through said pivot axis.

3. Planing machine according to claim 2, wherein said inclination adjustment means comprise;

an arm having one end and another end, said one end of said arm being pivotally connected to said truck at a mounting axis;

a fork-like portion defined at said other end of said arm, said fork-like portion having secondary arms;

a block located between said secondary arms of said fork-like portion;

two wings extending from said block and being connected to said fork-like portion;

a through-hole formed in said block;

a female thread formed in said truck;

a traction screw threadedly engaging said female thread and having one traction screw end and another traction screw end;

a stem defined by said traction screw and passing through said through-hole;

an actuation knob connected to said one end of said traction screw, and;

a self-locking nut connected to said other end of said traction screw.

4. Planing machine according to claim 1, wherein said contact portion defined by said treatment head comprises a monolithic disk, said monolithic disk being rigidly connected to said treatment head, and wherein said elastic biasing and positioning means comprise;

a threaded rod pivotally connected to said truck;

a pair of springs mounted on said threaded rod, said springs having facing ends and other ends, said monolithic disk being mounted on said threaded rod between said facing ends of said springs, and;

a pair of disks movably mounted on said threaded rod and being in contact engagement with said other ends of said pair of springs.

5. Planing machine according to claim 1, wherein said aspirator is accommodated within said truck and has an intake, and wherein said planing machine further comprises;

a flexible hose interconnecting said intake and said treatment head;

a conveyance tube interconnecting said flexible hose and said collection bag;

wherein said conveyance tube constitutes said grip handle extending upwardly from said rear portion of said truck.

6. Planing machine according to claim 1, wherein said at least one electric motor is accommodated in said treatment head, and wherein said planing machine further comprises;

a first belt extending between said motor and said aspirator;

at least one second belt extending between said motor and said two rollers, whereby to drive said rollers and said aspirator, and;

means for tensioning at least said first belt.

* * * * *